US010089970B2

(12) United States Patent
Silverman

(10) Patent No.: US 10,089,970 B2
(45) Date of Patent: Oct. 2, 2018

(54) HARNESS FOR A VIOLIN OR VIOLA

(71) Applicant: Tracy Silverman, Nashville, TN (US)

(72) Inventor: Tracy Silverman, Nashville, TN (US)

(73) Assignee: Silverman Musical Enterprises, LLC, Nashville, TN (US)

( * ) Notice: Subject to any disclaimer, the term of this patent is extended or adjusted under 35 U.S.C. 154(b) by 0 days.

(21) Appl. No.: 15/489,860

(22) Filed: Apr. 18, 2017

(65) Prior Publication Data

US 2017/0301327 A1 Oct. 19, 2017

Related U.S. Application Data

(60) Provisional application No. 62/324,101, filed on Apr. 18, 2016.

(51) Int. Cl.
*G10G 5/00* (2006.01)

(52) U.S. Cl.
CPC ..... *G10G 5/005* (2013.01)

(58) Field of Classification Search
CPC ..... G10G 5/005
See application file for complete search history.

(56) References Cited

U.S. PATENT DOCUMENTS 2,697,374 A * 12/1954 Elgard ..... G10D 3/18 84/280
4,251,016 A * 2/1981 O'Rafferty ..... G10G 5/005 224/250

* cited by examiner

*Primary Examiner* — Kimberly Lockett
(74) *Attorney, Agent, or Firm* — Greenspoon Marder LLP

(57) ABSTRACT

An ergonomic harness system for hands-free support of violins and violas that incorporates two partly overlapping concave/convex shaped plates with attached rib tabs on each end that secure the plates to the instrument in a cross-pattern at the C-bouts and bottom edge of the instrument body. Mechanisms for expanding and contracting the plates allows the harness to accommodate instrument size variations and provides an adjustable binding force. A telescoping chest pad is secured to one end of the concave plate for supporting the instrument using the body.

18 Claims, 9 Drawing Sheets

HARNESS FOR A VIOLIN OR VIOLA

BACKGROUND OF THE INVENTION

Violinists (and especially violists) can incur injury and pain to their upper back and neck regions due to the common methods of supporting the instrument using the chin and shoulder. Typically, the left shoulder is elevated to support the body of the instrument and can be held in this elevated position for extended periods of time. For example, when a musical piece is technically difficult, a musician may generate substantial movement of the upper shoulder positions while performing. Providing consistent support for the instrument under such conditions, the musician often must apply excessive pressure between the chin and shoulder to pin the instrument in place. As a result, many musicians incur significant expense on chiropractic care and physical therapy to provide relief from discomforts involving the spine, nerves and muscles of the neck, shoulder and upper back. In addition to the ergonomics of instrument support, many musicians must cease supporting and performing their instrument from time to time to allow their chin to be moved during singing. What is needed in the art is a neck strap for a violin or viola that provides both an ergonomically improved support for the instrument during performing yet does not involve the use of the shoulders, neck and head. Such a strap would also allow a musician to play the instrument and sing simultaneously, if so desired.

Existing straps for acoustic violins generally cannot provide simultaneous instrument support and allow maximum freedom of movement. One type of strap employs a belt of fabric placed around the neck and under the arm, like a standard guitar strap. This type strap is often secured to the instrument by threading it under the tailpiece of the violin, which sets the weight of the instrument on the tail piece and end pin. This type of design is not a structurally sound configuration for a violin.

What is needed in the art is a harness attached to the instrument that protects it from scratching or structural damage. Such a harness can be connected to a neck strap so that the novel harness system would form a complete system for supporting the instrument during all performances. Such a harness system does not pass under the musician's arm, nor would it bolt into the instrument, nor require any modification to the instrument.

This novel harness system should further be lightweight, strong, comfortable, aesthetically simple and beautiful. The harness system should also be as small as possible and collapsible to fit in a standard instrument case. The harness system should also attach quickly and securely to the instrument while not affecting the acoustics of the instrument and not requiring any physical modification to the instrument. Finally, the harness system should be adjustable and be available to musicians at an affordable price. In one embodiment, the harness system comes in two basic sizes, one for violin and a slightly larger size for viola.

SUMMARY OF THE INVENTION

The device presented is a combination of an adjustable neck strap that clips onto a lightweight harness. The harness presented is comprised of a concave-shaped plate and a convex-shaped plate inverted relative to each other and partly overlapping. A fastener is provided to allow vertical displacement of the plates while attaching the harness so that it is adaptable to most all instrument shapes and sizes. In the one embodiment, the harness clasps a violin or viola symmetrically at two tabs in the C-bouts and two tabs along the bottom body of the instrument. The points of contact between the harness tabs and the surface features of the instrument are fitted with a malleable material that compresses slightly when the harness is tightened around the instrument. In another embodiment, an adjustable, padded chest support arm is attached to the harness for additional support options. In another embodiment, the harness is fitted with an alternate adjuster such as a standard worm gear mechanism and a quick-release lever.

DETAILED DESCRIPTION

Figure 1:
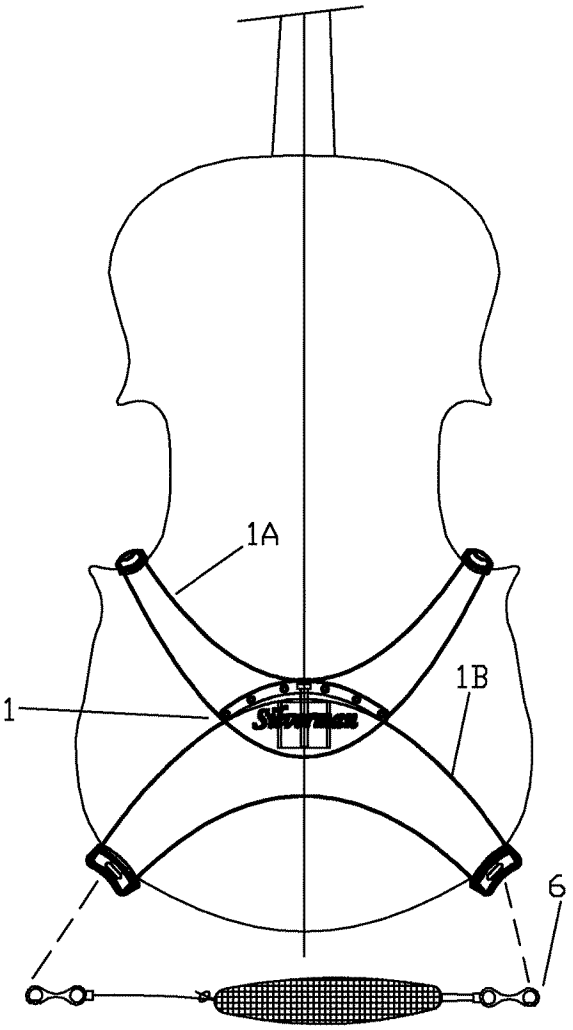
FIG. 1 is a plan view of the rear face of a violin body showing the harness system of the present invention. For reference, in the drawings and in the detailed description to follow, the term "upper" means closer to the C-bouts and the term "lower" means closer to the bottom of the violin.

Referring to FIG. 1, one embodiment of the harness system is comprised of a standard neck strap 6 and an instrument harness 1. The instrument harness is further comprised of two partly-overlapping, rigid harness plates, 1A and 1B. The upper harness plate, 1A engages the instrument in at least two points on opposite sides of the instrument at each of the lower curves of the C-bouts (a C-bout is the C-shaped curve in the middle of the sides of a violin which forms its "waist"). The lower harness plate attaches at two points on opposite sides of the instrument at each of the curves that converge to the bottom of the instrument and closest to the musician's upper torso when the instrument is played.

Figure 6:
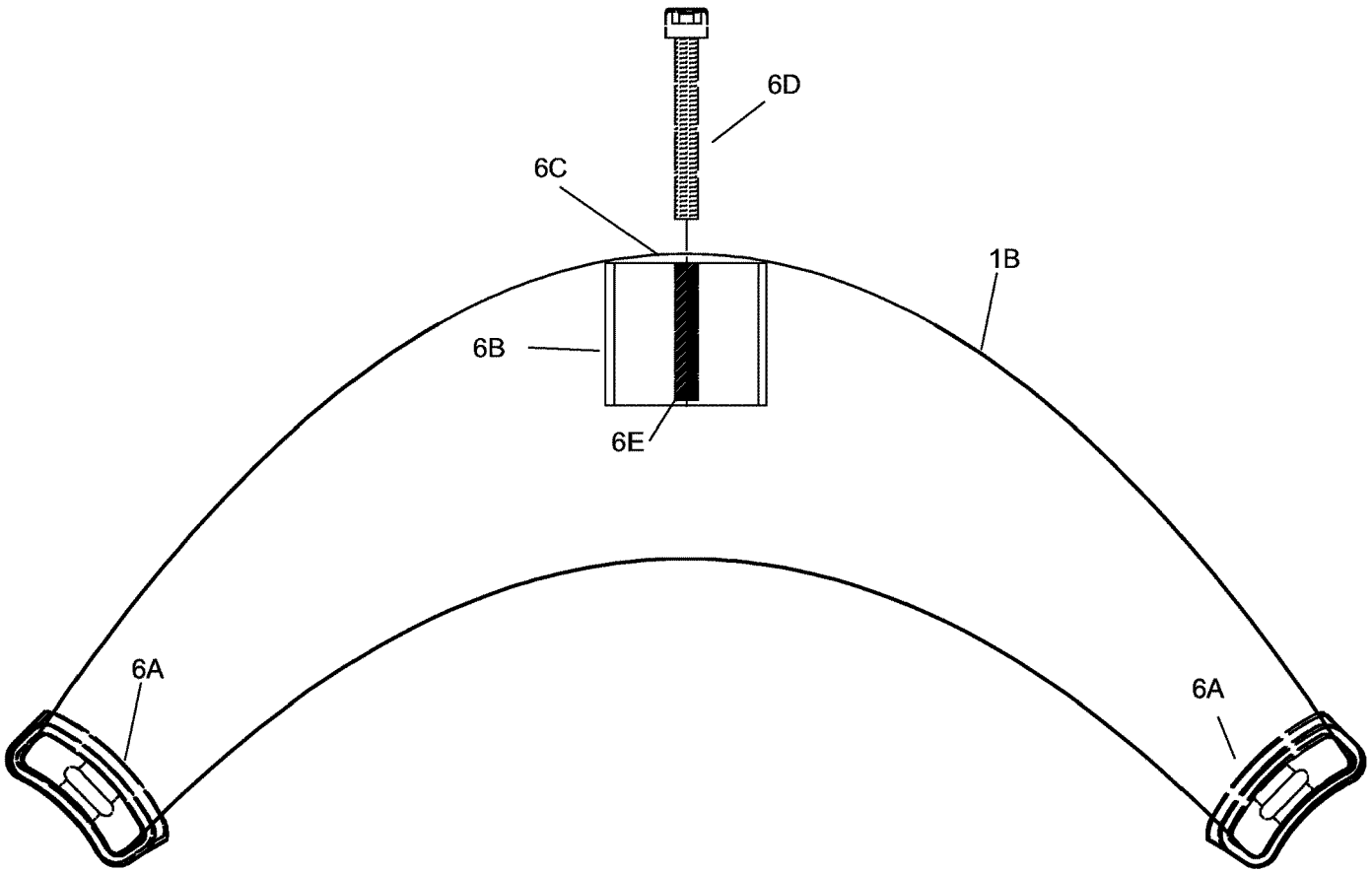
FIG. 6 is a top view of the lower harness plate and shows the threaded guide block, and the guide block fastener.

In continued reference to FIG. 1, and in more detail in FIG. 6, the neck strap 6 can be a short, adjustable, padded neck strap similar type to those used with a saxophone. In the embodiment of FIG. 1, the strap attaches to the harness at either of the lower plate contact points. In one embodiment, the strap is fitted on either end with standard swivel bolt snap hooks that can connect to the lower plate contact points to allow the strap to rotate without applying torque to the strap.

Figure 2:
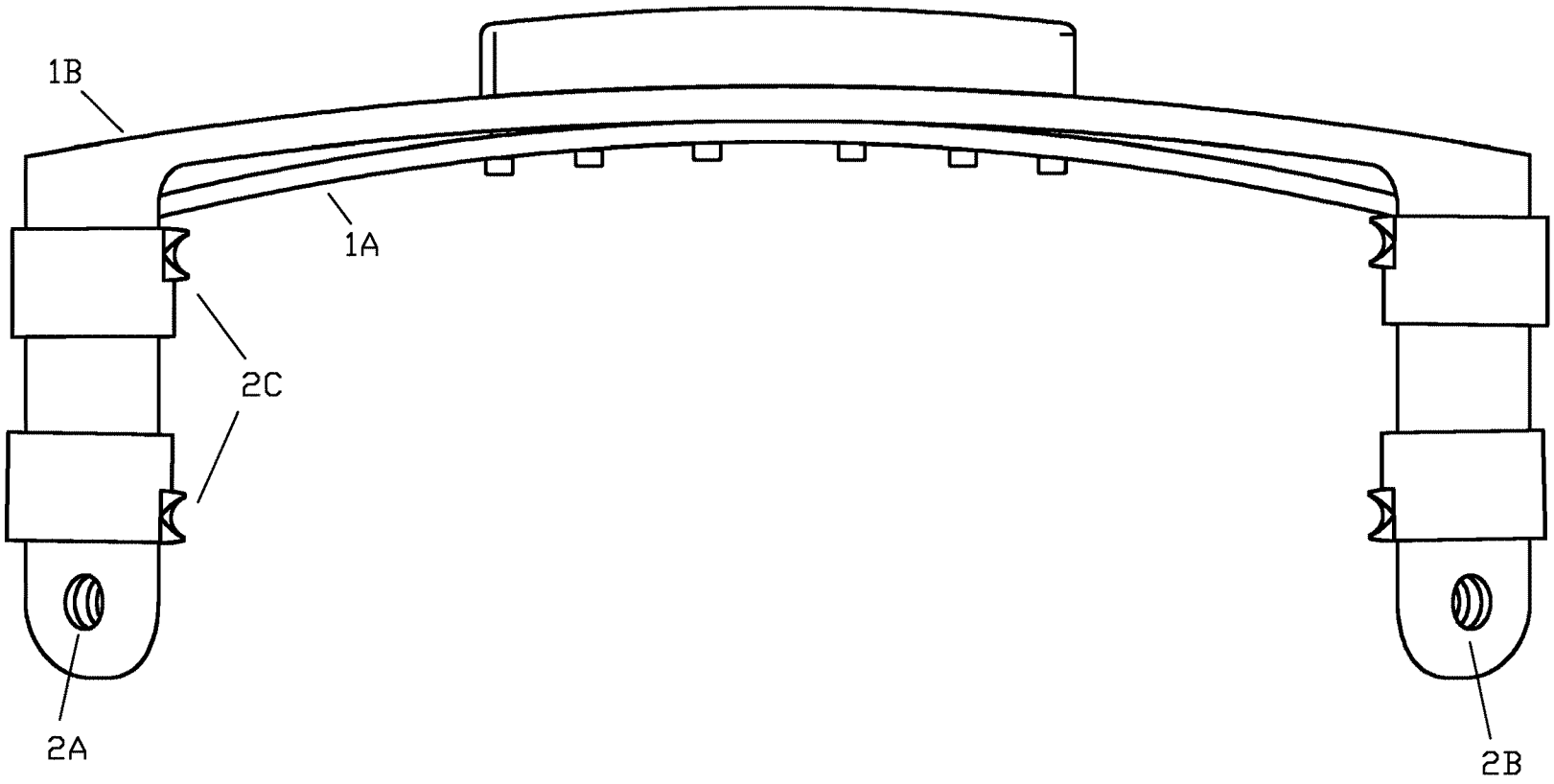
FIG. 2 is a side view of the harness system positioned in FIG. 1 with the lower rib tabs in the foreground and the upper rib tabs in the background hidden behind.

Referring to the embodiment of FIG. 2, the upper and lower harness plates 1A and 1B can be fabricated from a thin frame made of carbon fiber, plastic, metal or other strong, lightweight material which securely anchors to the back of the instrument at the points of contact. The function of the harness is to securely attach to the instrument in a minimum of four symmetrically distributed attachment points and to provide at least two attachment points for the neck strap.

In continued reference to FIG. 2, at least two rib tabs 2A and 2B extend outward from the lower harness plate 1B over the top of the instrument and serve as attachment points for the strap. In one embodiment, the harness plates are substantially planar, but in the embodiment of FIG. 2, the harness plates can be slightly arched to match the curved profile of the back of an instrument. In one embodiment, the harness is low profile matching the curve of an instrument so that it can remain on the instrument while in the case.

In continued reference to of FIG. 2, the rib tabs of the bottom harness plate extend away from the lower plate at a right angle to the centerline of the plates. In one embodiment, the rib tabs include one or more soft saddles 2C that engage the instrument edges securely without damaging the instrument when the harness is tightened or attached. These soft saddles clasp the extended edging of the front and back surfaces of the instrument, which is common to many violin designs. However, other soft saddle shapes and positions could be added or even customized to accommodate other instrument shapes. In one embodiment, the soft saddles are formed from flexible reinforced silicon or neoprene rubber and are readily stretched over the rib tabs and positioned as the musician desires to optimally contact and stabilize the harness to their particular instrument shape. When the stretching is released, the soft saddle grips the rib tab with sufficient force to be relatively immovable when the harness is tightened in place about the instrument. In the one embodiment, the rib tabs of the lower plate have two soft saddle contact points that engage the extended front and rear edging common to many types of violins. The rib tabs of the C-bout contact points of the upper plate have at least one soft saddle that engages the extended edge of the rear face of the instrument. On the ends of the rib tabs, holes 2A and 2B are provided for attaching a neck strap. The neck strap can attach to the rib tabs using a swivel bolt snap hook, which also can be coated with a material that reduces any undesired sounds caused by the vibration of the instrument. Also, in one embodiment, the profile of the rib tabs are contoured to match the surface shape of the instrument at each contact point. In another embodiment, the profile of the rib tabs can be rounded opposite the contour of the instrument so they will easily receive different angles and curves of varying instruments by minimizing the contact points. Contouring the rib tab contact points to a rounded shape with a curvature opposite the curvature of the instrument is generally better for preventing damage to the instrument and allows for reduced thickness of the soft saddles, which would have to fill in the spacing between the rib tab and instrument if the rib tab were flat or non-contoured.

Figure 3:
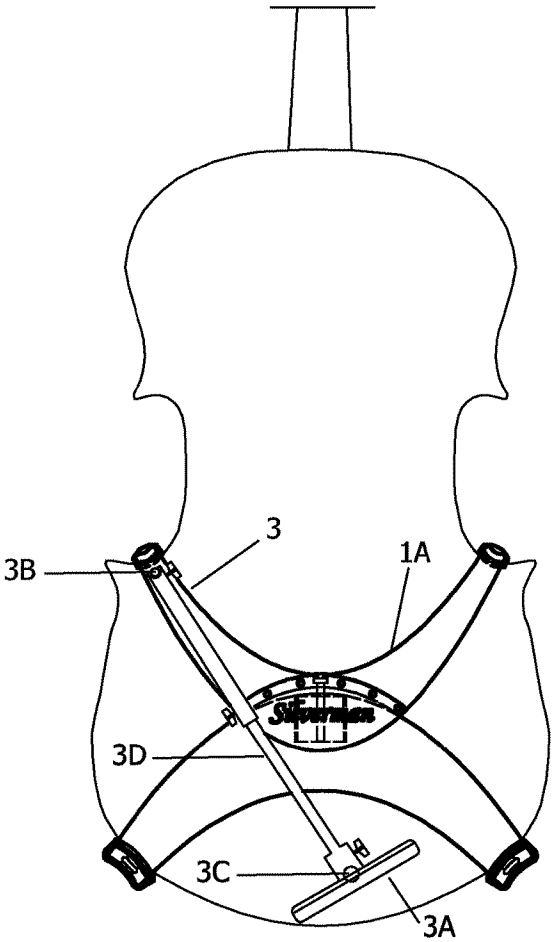
FIG. 3 is a plan view of the harness shown in FIG. 1 with a chest support arm installed.

In the embodiment of FIG. 3, an adjustable chest support arm 3 is attached to one end of the upper harness plate 1A using a rotatable joint 3B. The adjustable chest support is then extended until a stop pad 3A on the end of the arm engages the musician's body to provide hands-free support of the instrument while in the playing position. The adjustable chest pad can either be permanently attached to the upper harness plate at the rotatable joint 3B or can be readily separated from the harness using a quick-release strap-lock, such as, for example, a quick release used by modern guitarists. For low-profile instrument cases, the chest support arm is removable for placement elsewhere in the case when the instrument is stored. In another embodiment, a storing clasp can be installed on either of the plates for receiving and securing the adjustable chest pad support arm when the instrument is not being played or the musician is not in need of chest support arm.

In one embodiment, the plates are bound together by a single threaded fastener that is tightened after the rib tabs are placed at their proper positions. In another embodiment, the two harness plates are bound together by an alternate fastener comprising a standard worm gear ratcheting mechanism and a quick-release lever. Using this embodiment, the harness plates are expanded and retracted in one direction relative to each other by simply toggling the quick-release lever between a "loose" and "locked" position.

DETAILED DESCRIPTION OF THE DRAWINGS

In continued reference to FIG. 2, a side view of the lower harness plate 1B is shown with the upper harness plate 1A behind the lower plate and extending into the background. The surface finish of the plates allows them to readily slide against each other. The lower harness 1B plate is rigid and is designed to retain its basic shape. Generally, the thickness of the plate that provides the requisite rigidity will vary depending on the type of material the plates are made from. Also, one method known in the art that can add rigidity to certain materials such as metals, is to break the edges at an acute angle to the plane of the plate. Adding rigidity using either edge-breaking or adjoining a stiffener to the plate will allow for lighter plate weight, thickness and manufacturing cost.

In reference to FIG. 3, an adjustable chest support is attached near one of rib tabs of the upper plate. The chest support consists of a telescoping arm 3 and a chest pad 3A which are connected to the harness with an upper rotatable joint 3B. The rotatable joints at 3B and 3C and the telescoping arm at 3D provide the chest support a wide range of adjustment options to accommodate different instrument positions and different body heights and orientations during playing and can be readily collapsed into another position to fit in a violin case. The chest support arm can also hold the instrument in playing position without the musician's hand supporting the instrument neck. The rotatable chest pad 3A can also be fitted with a soft contact surface, such as a ⅜" foam pad, where it contacts the musician's body. Where the chest pad joins the telescoping arm, a lower rotatable joint 3C is placed to allow additional positioning of the chest pad to the musician's comfort. In one embodiment, the chest support arm can be readily detached at the rotatable joint 3B using a quick-release mechanism commonly used on guitar strap-locks. In another embodiment, a stowing clasp is attached to one of the plates so that the chest support arm is secured into a fixed position when the chest pad is not being used.

Figure 4:
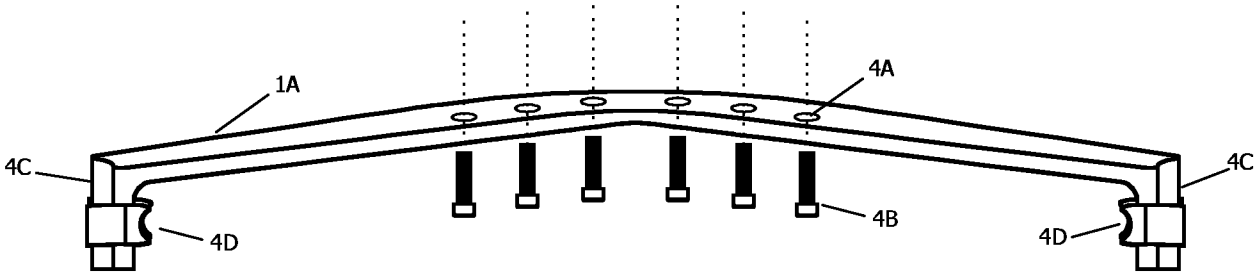
FIG. 4 is a side view of the upper harness plate and the plurality of fasteners that secure the guide rail to the upper harness.

In reference to FIG. 4, a side view of the upper harness plate is shown. The upper harness plate can also be profiled to match the contour of the instrument. In one embodiment, the upper harness plate is smoothly curved. The upper harness plate 1A can be made from the same material as the lower harness plate and of a similar construction to the various embodiments disclosed. The edges of the upper harness plate can also be broken (i.e., bent in a stiffening brake) to increase the rigidity of the plates. A plurality of fastener holes 4A are inserted into the upper plate symmetrically about the centerline of the plate to receive fasteners 4B that secure the upper and lower plates together. A pair of rib tabs 4C extend at a right angle from the centerline of the plate and include a pair of soft saddles 4D that engage the instrument. In one embodiment, the rib tabs of the upper plate have a convex profile that more closely matches the concave profile of the C-bouts at points of contact.

Figure 5:
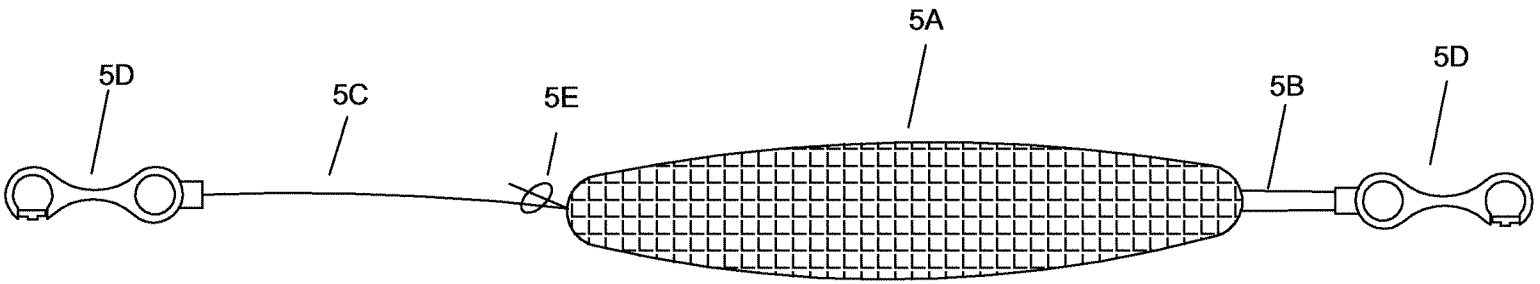
FIG. 5 is a view of a typical padded neck strap that can be connected to the harness.

In reference to FIG. 5, a standard neck strap is shown for use with the instrument body harness. An adjustable, padded neck strap (such as the kind used for a saxophone) attaches to the harness at one or more of the harness plates using quick-release clasps 5D. The area contacting the musician 5A can be made of stretchable padding, such as foam. In one embodiment, the strap can be thickest in the middle where it contacts the musician's neck and tapered on the ends where it attaches to the harness. Typically, one end of the tapered strap pad terminates in a short synthetic cable 5B which includes a swivel quick-release thumb clasp 5D. The other end of the tapered strap pad includes an extended, thinner synthetic cable 5C, due to the instrument being held somewhat to the side, and terminates into a second swivel quick-release clasp. At the point where the thinner cable meets the neck pad, there is also an adjustable clasp 5E that can vary the length of the thinner strap cable.

In reference to FIG. 6, a top view of the lower harness plate 1B is shown. The rib tabs 6A extend at a right angle away from the plane of the plate and contain a plurality of soft saddles that contact the top and bottom edges of the instrument. A threaded guide block 6B can either be centered and affixed to the top surface of the plate near the edge of the top arch 6C of the plate, be comprised of a threaded block placed within a similarly-sized recessed cavity into the surface of the lower harness plate, or be integrally formed in the upper or lower harness plate. In either embodiment, the threaded guide block provides a structure that extends upward from the plane of the plate and engages a similarly-sized cavity in the fastening block. The fastening block is secured to the lower harness plate using a single fastener 6D that is inserted through a hole in the side of the fastener block and into matching female threads 6E into the guide block 6B. With the fastener loosened around ½ to ¾ inch, the plates can separate outward relative to each other to fit around the instrument. The fastener is then tightened, which pulls the plates together and compresses the rib tab's soft saddles at their points of contact, securing the harness to the instrument. As a general matter, the requisite amount of saddle compression against the instrument imparted by tightening the fastener is predetermined for a given sized instrument and sets the general length, shape and angle of the harness plates. The length of the fastener is such that it can accommodate smaller variations in any given class of instruments. For example, since the body dimensions of a full-sized viola are generally larger than a violin, and the contours of the C-bouts and bottom body thickness are slightly different, the harness plate dimensions are proportionally increased or decreased to accommodate these differences. Violins are generally sized from "full scale," which equates to a 14" body length and 32" or 32½" overall length down to "1/32 scale, which equates to 7½" body length and 13 or 13½" overall length. Violas are generally sized from 16½" body lengths down to 12" body lengths. Even these dimensions can vary slightly from one manufacturer to another. In the one embodiment, the harness plates are sized and the rib tabs are profiled such that the harness can safely and surely fit the most number of violin and viola sizes or scales. Other embodiments of the invention can be scaled versions optimized to provide the requisite compressive force for any given scale of the instrument.

Figure 7:
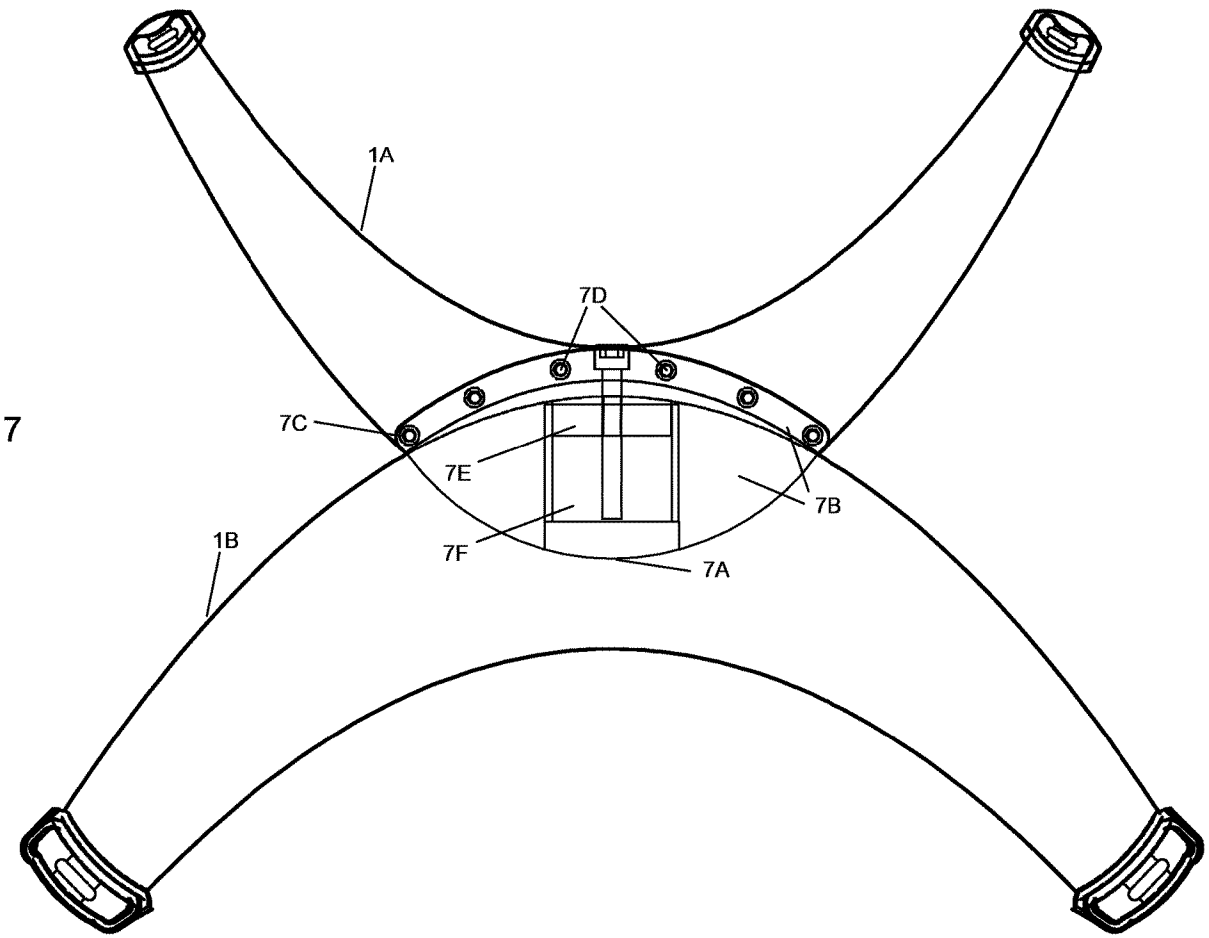
FIG. 7 is an enlarged version of the harness shown in FIG. 1 showing the upper and lower harness plates bound together and the fastening block with the single fastener of FIG. 6 in its tightened location.

In reference to the embodiment of FIG. 7, a part of the lower harness plate 1B overlaps the upper harness plate 1A up to the middle of the lower harness plate at 7A, which marks the lowest point of the arch in the upper harness plate. The required length and width of each plate is determined by the dimensions of the instrument body and this minimum overlap area of the plates up to the middle of the lower plate. Overlapping to the midpoint of the lower plate at 7A is the minimum distance that provides sufficient stability to the harness when the plates are secured together. The minimum overlap can vary depending on the strength and rigidity of the material used to form the harness. In one embodiment, the area of overlap of the two plates forms the shape of a prolate spheroid 7B, or an American football-shape. A similarly shaped fastening block 7C is placed on top of the lower plate over this area of plate overlap. The fastening block has a generally planar top and bottom sides, except for a guide rail 7C that extends away from the bottom face of the fastening block down to the upper face of the upper harness plate 1A. The fastening block and guide rail can be integrally-formed components. The guide rail binds to the upper harness plate while the tightening fastener binds the fastening, the upper harness plate and the lower harness plate together. A plurality of female fastener threads 7D are installed into the bottom face of the guide rail 7C. The curved shape of the guide rail 7C matches the curved shape of the lower harness plate 1B to facilitate assembly of the harness. The fasteners are positioned symmetrically about the centerline of the guide rail and are evenly-spaced apart. Holes matching this fastener pattern are bored through the upper plate. A threaded block 7E is either attached permanently to the upper face of the lower harness plate or it can be inserted into a corresponding recessed cavity into the upper face of the lower harness plate. A cavity 7F is formed inside the fastening block. As the tightening fastener is turned, the threaded block moves in one direction within cavity 7F. In the embodiment of FIG. 7, 6 evenly-spaced fasteners are shown and the alignment block is essentially square and aligned with the centerline of the harness plates.

Figure 8:
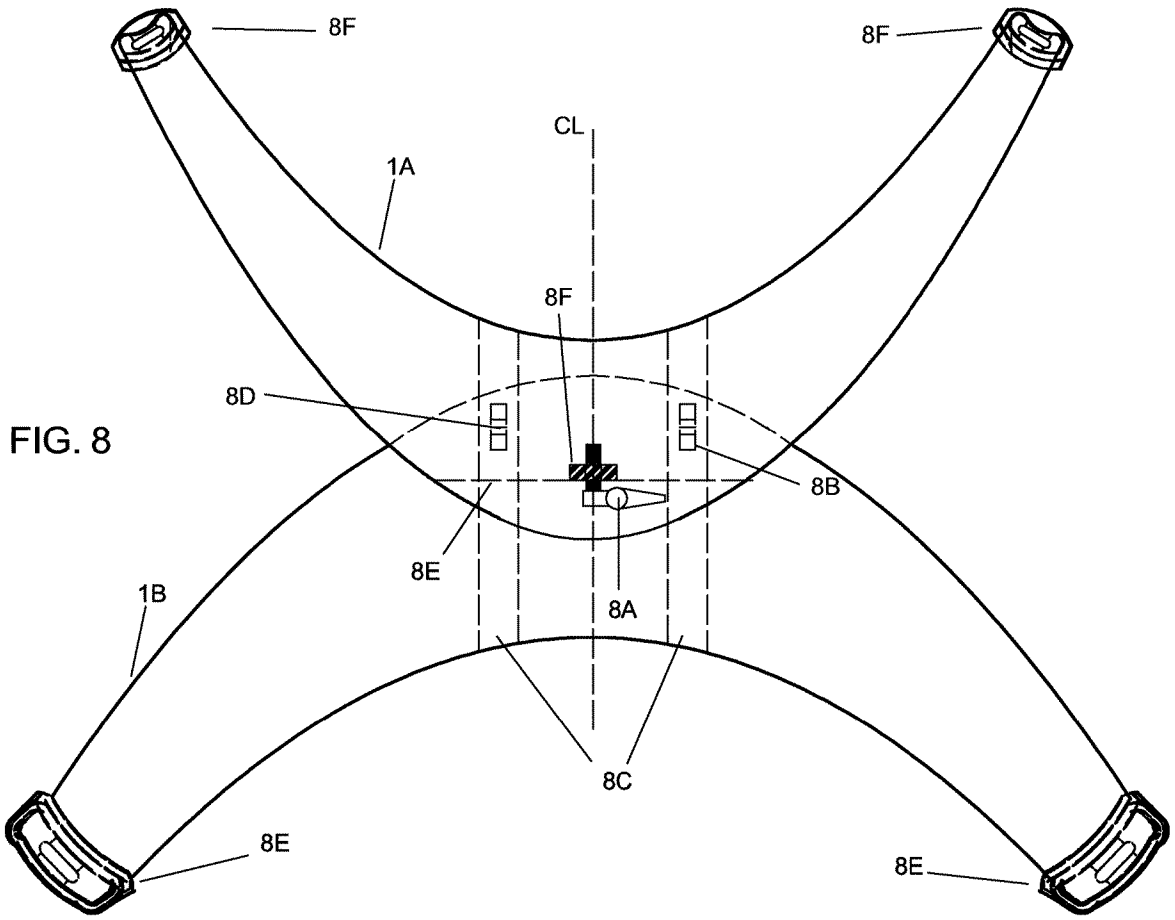
FIG. 8 shows another embodiment of the harness where the upper and lower harness plates are vertically adjustable relative to each other employing a worm-gear mechanism and a quick-release locking lever. Concave and convex guide channels are also formed into the upper and lower harness plates to add rigidity to the plates and horizontal stability of the plates relative to each other as they are vertically adjusted.

In the embodiment of FIG. 8, slightly different features are added to the harness plates to accommodate an alternate vertical adjustment and plate-locking mechanism. In this embodiment, a standard worm-gear type mechanism 8A is located near the middle center of the lower harness plate 1B. A plurality of rectangular slots 8B are installed into the upper plate. A corresponding plurality of rectangular, threaded tabs 8D extend upward from the lower harness plate through the rectangular slots 8B of the upper plate. The rectangular slots of the upper plate are larger in length than the rectangular tabs so that as the plates are vertically adjusted, the tabs move within the rectangular slots. The width of the rectangular slots is more closely sized to the width of the rectangular tabs so that the upper harness plate remains properly aligned with the lower harness plate during movement. Two rounded groove contours 8C can be formed into the lower harness plate which fit into corresponding groove contours of the upper harness plate. The contour of the upper plate can be convex relative to the instrument while the matching contour of the lower plate can be concave so to minimize localized contact with the instrument. As with other embodiments disclosed, the overall contour of the plates can be customized for different instruments or be sufficiently rounded to accommodate the instrument models with the greatest arches. The bottom end of the lower harness plate terminates into two rib tabs 8E, which grip the edge of the instrument and provide attachment points for the strap.

In continued reference to the embodiment of FIG. 8, the lowermost end of the upper plate arch is segmented at 8E to accommodate the vertical adjusters 8A. A plurality of rectangular slots 8B receive matching rectangular tabs extending outward from the surface of the lower plate. It should be noted that in the embodiment of FIG. 8, the upper plate overlays the top surface of the lower plate. Whereas, in the embodiment of FIG. 7, the lower plate over lays the top surface of the upper plate. In either configuration, the overlap extends at a minimum to the midpoint of the lower plate, or slightly more, to maximize the rigidity of the plates when secured together. A threaded guide nut 8F is attached to and extends outward from the bottom surface of the upper harness plate. The guide nut is aligned with the centerline of the upper plate and receives a male thread screw that is rotated into the threads by toggling the worm gear and quick-release lever mechanism. The rectangular posts 8B can be designed to include other shapes, such as cylindrical or triangular, as the posts primarily form guides that prevent horizontal movement of the plates while allowing limited vertical movement.

In continued reference to FIG. 8, the vertical adjustment mechanism 8A provides a reliable and securable method for moving the harness plates relative to each other until the upper rib tabs 8F engage the C-bouts. The worm-gear, quick-release lever mechanism is known in the art and is a similar mechanism installed on some guitar headstock e-string tuners. When the locking nut is released, the tuning of the string changes to a preset position (e.g., going from a standard E note to a D note). Although the linear distance change these worm gear, quick-release levers provide is generally limited, they are nonetheless suitable for adaptation to the harness plates as the extent of vertical adjustment required for most violins and violas is less than ¾" of an inch. Once the travel stop of the mechanism is set for a given instrument, the musician need only open or close the quick-release locking lever to secure remove or secure the harness to the instrument body.

Figure 9:
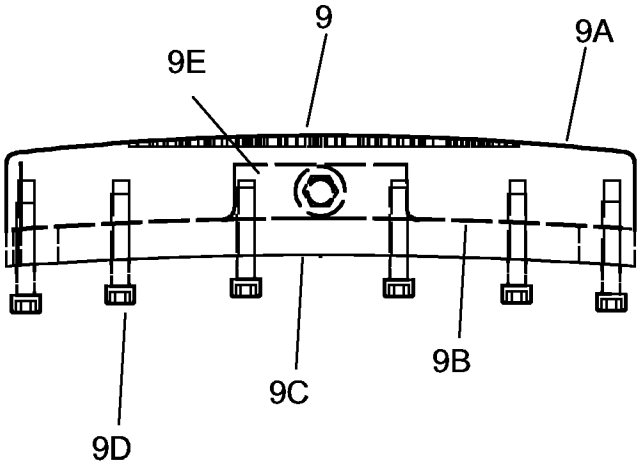
FIG. 9 is a side view of the fastening block of one embodiment of FIG. 7 which shows the guide block cavity, the guide rail and the harness fasteners are shown in their final position. Portions of the bodies of the upper and lower plates are also shown in their relative position.

In reference to FIG. 9, a side view of the fastening block used with another embodiment is shown. The fastening block 9 consists of a prolate spheroid shape with substantially planar top and bottom faces 9A and 9B, respectively and an arching guide rail 9C that extends down below the fastening block to contact the upper surface of the upper harness plate. The arch of the guide rail 9C generally matches the convex profile of the of the lower harness plate (see FIG. 7, at 7C). The overall height of the fastening block is generally determined by the length of fasteners selected. The guide rail 9C extends below the edge of the upper edge of the lower harness plate down to the upper face of the upper harness plate. Since the guide rail 9C is curved to match the convex profile of the lower harness plate, the fastening block and lower harness plate readily fit together and only further require the alignment of the fastener holes in the upper harness plate to the female threads of the guide rail and insertion of the fasteners to complete the harness assembly. A plurality of fasteners 9D are symmetrically distributed about the centerline of the guide rail and are evenly spaced apart. A cavity 9E is formed in the fastening block for receiving the guide block (see FIG. 6, item 6D). Finally, a hole is inserted into the side wall of the fastening block for receiving the threaded section of the tightening fastener (see FIG. 6, item 6E). When tightened, the fastener head pulls the upper harness plate toward the lower harness plate and ultimately binds the harness components together securely. The fastening block of FIG. 9 can be used with the embodiments shown in FIGS. 1-4, and 6-7.

In reference to the embodiment of FIG. 8, the locking quick-release lever binds the two plates together when placed in the "locked" position. When the lever is flipped to the "unlocked" position, the rectangular slots and guides as well as the groove contours allow vertical movement but prevent horizontal movement between the two harness plates. In reference to this embodiment, the tightening fastener and insert block perform essentially the same translational functions of movement and control.

Finally, in one embodiment, the harness plates are cast into a single, non-vertically-adjusting harness system. In this embodiment, the stiffness of the composite harness plate and or the rib tabs would provide a spring force that secured the harness to the instrument. If formed from an optimally flexible material, the musician could bend back slightly the rib tabs and the harness plates and insert the harness on to the instrument body. When the tabs and or harness plates flex back their normal position, a binding force is applied that compresses the soft saddles to the instrument securely. For the composite body embodiment, the harness plate and rib tabs can be uniformly coated with the compressible material to minimize the potential for wear between the harness and the instrument.

MISCELLANEOUS

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing an invention (especially in the context of the following claims) are to be construed to cover both the singular and the plural, unless otherwise indicated herein or clearly contradicted by context. The terms "comprising," "having," "including," and "containing" are to be construed as open-ended terms (i.e., "including, but not limited to,") unless otherwise noted. Recitation of ranges as values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention (i.e., "such as, but not limited to,") unless otherwise claimed. No language in the specification should be construed as indicating any non-claimed element as essential to the practice of the invention.

One embodiments of this invention are described herein. Variations of those one embodiments may become apparent to those having ordinary skill in the art upon reading the foregoing description. The inventors expect that skilled artisans will employ such variations as appropriate, and the inventors intend for the invention to be practiced other than as specifically described herein. Accordingly, this invention includes all modifications and equivalents of the subject matter recited in the claims appended hereto as permitted by applicable law. Moreover, any combination of the above-described elements in all possible variations hereof is encompassed by the invention unless otherwise indicated herein or otherwise clearly contradicted by context.

While the disclosure above sets forth the principles of the present invention, with the examples given for illustration only, one should realize that the use of the present invention includes all usual variations, adaptations and/or modifications, within the scope of the claims attached as well as equivalents thereof. Those skilled in the art will appreciate from the foregoing that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A harness for supporting a violin or viola in a playing position comprising:

a pair of upper tabs fitted with a compressible material for engaging a rear edge of an instrument having a C-bouts, the upper tabs fitted symmetrically at the C-bouts and providing a binding force for securing the upper tabs and the instrument together;

a pair of lower tabs fitted with a compressible material for engaging a front edge and the rear edge of the instrument symmetrically along a bottom arch and providing a binding force securing the upper and lower tabs and the instrument together; and a partly rigid support plate connected to each of the upper and lower tabs;

wherein the harness can be fastened to an adjustable neck strap.

2. The harness of claim 1 where the partly rigid support plate also contributes a binding force securing the upper and lower tabs and the instrument together.

3. The harness of claim 1 further comprising a pair of attachment points extending out from the lower tabs for providing attachment points for the neck strap.

4. The harness of claim 1 wherein the partly rigid support plate is comprised of a convex plate connected to the upper tabs, the convex plate overlaps a concave plate connected to the lower tabs forming an overlapping area such that binding the plates together provides the binding force securing the tabs to the instrument.

5. The harness of claim 4 wherein the overlapping area of the convex and concave plates are configured to expand and contract at the overlapping area such that additional compressive binding force can be applied to the tabs for securing them to the instrument.

6. The harness of claim 5 further comprising:

a worm-gear mechanism attached to a locking quick-release lever;

a threaded shaft attached to the worm-gear;

a receiving nut secured to a centerline of one of the plates for receiving the threaded shaft;

one or more guide cavities inserted into a receiving nut plate; and one or more guides corresponding to the guide cavities of the receiving nut plate such that the overlapping area expands or contracts when the quick-release lever is toggled.

7. The harness of claim 6 wherein the worm-gear, threaded shaft and receiving nut allow up to ¾ of an inch of linear plate overlap movement while the quick-release lever is toggled and locked so that the harness can accommodate a variation in instrument dimensions.

8. The harness of claim 6 further comprising concave and convex channels formed into the convex and concave plates to provide more resistance against lateral displacement of the plates as they expand and contract when the quick-release lever is toggled.

9. The harness of claim 5 further comprising:

a tightening screw positioned along a centerline of the overlapping plates;

a threaded block positioned along the centerline of one of the overlapping plates for receiving a tightening fastener;

a plurality of fastener holes in one of the overlapping plates symmetrically distributed and evenly spaced about another of the overlapping plate's centerline; and a fastening block having threads matching the plurality of fastener holes for securing the fastening block to the plates, a cavity for receiving and containing the fastening block such that the block can only move linearly, and a side hole for receiving the tightening fastener;

such that the tightening fastener holds the support plates together and binds the tabs to the instrument while also binding the harness together.

10. The harness of claim 9 wherein the tightening fastener further comprises a length of the tightening fastener that allows up to ¾ of an inch of linear plate overlap movement while the fastener remains securely in the block so that the harness can accommodate variations in instrument dimensions.

11. The harness of claim 1 wherein the upper tabs are profiled to match a shape that approximates a shape of the instrument's C-bouts so that the requisite binding force required to secure the harness to the instrument is minimized.

12. The harness of claim 1 wherein the lower tabs are profiled to match a shape that approximates a shape of the bottom arch of the instrument so that the requisite binding force required to secure the harness to the instrument is minimized.

13. The harness of claim 1 further comprising an extended rear edge, wherein the compressive material of the upper and lower tabs engages the extended rear edge of the instrument.

14. The harness of claim 13 further comprising an extended front edge wherein the compressive material of the lower tabs also engages the extended front edge of the instrument.

15. The partly-rigid support plate of claim 1 further comprising an end and the harness of claim 1 further comprising an adjustable, telescoping chest support pad connected to the end of the partly-rigid support plate by a rotatable joint.

16. The harness of claim 15 wherein the rotatable joint of the chest support pad can be decoupled from the partly-rigid support plate using a quick-release mechanism.

17. The harness of claim 1 further comprising contact points between the instrument and the upper tabs, wherein the upper tabs are rounded opposite the curvature of the instrument's C-bouts so that the requisite binding force required to secure the harness to the instrument and a required number of contact points are minimized.

18. The harness of claim 1 further comprising contact points between the instrument and the lower tabs, wherein the lower tabs are rounded opposite a curvature of the instrument's C-bouts so the requisite binding force required to secure the harness to the instrument and a required number of contact points are minimized.

* * * * *